United States Patent [19]

Galloway

[11] Patent Number: 4,688,495

[45] Date of Patent: Aug. 25, 1987

[54] HAZARDOUS WASTE REACTOR SYSTEM

[75] Inventor: Terry R. Galloway, Berkeley, Calif.

[73] Assignee: In-Process Technology, Inc., Redwood City, Calif.

[21] Appl. No.: 760,944

[22] Filed: Jul. 31, 1985

Related U.S. Application Data

[63] Continuation-in-part of Ser. No. 681,255, Mar. 25, 1977, abandoned.

[51] Int. Cl.[4] ..... F23G 5/00; F23G 5/10; F23G 5/12

[52] U.S. Cl. ..... 110/250; 110/236; 110/237; 110/256

[58] Field of Search ..... 110/250, 237, 256, 236, 110/346

[56] References Cited

U.S. PATENT DOCUMENTS 3,496,890 2/1970 LaRue ..... 110/250 X
4,479,443 10/1984 Faldt et al. ..... 110/237 X

*Primary Examiner*—Edward G. Favors
*Attorney, Agent, or Firm*—Alvin E. Hendricson

[57] ABSTRACT

A thermal decomposition reactor accepts solid, liquid or gaseous waste products of industrial processes or the like and rapidly reduces same to substances such as carbon dioxide, water and glassified non-leachable ash without limitation by materials that may be commonly included in such waste.

17 Claims, 5 Drawing Figures

HAZARDOUS WASTE REACTOR SYSTEM

RELATED APPLICATIONS

This is a continuation-in-part of my prior copending U.S. patent application Ser. No. 681,255 filed 3/25/77 entitled Hazardous Waste Disposal System, now abandoned.

BACKGROUND OF INVENTION

Present practices in the storage of spent solvents activated carbon, heavy metals, and other hazardous waste, requiring pickup and disposal through industrial waste haulers, has resulted in serious political and environmental problems for both the chemical and electronic industry. Ground water contamination and occupational health problems have been steadily increasing. In addition, under the Federal RCRA (Resource Conservation and Recovery Act) there are long term legal risks to the hazardous waste generator resulting from the ultimate fate of these materials, which is referred to as the "cradle-to-grave" responsibility of the generator. Only the largest producing companies can afford the costs of the large incineration furnaces capable of combusting these organic waste to EPA-acceptable levels. There exists a present need for new technology that is better matched to the scale of the problem and the capital available.

In addition to the foregoing, there have been developed many systems and/or reactors designed to "eliminate" waste from the world. Such systems normally operate upon the "garbage" of the world and some are even directed to the destruction of "garbage" having therein some chemical substances that could be detrimental to human health. Most "waste disposal systems" are directed to the incineration or other disposal of general waste products.

High temperature waste reactors are very large and expensive and incorporate limitations as to materials operated upon such as in U.S. Pat. No. 3,933,434 to Matovich and following patents of the same inventor. Other waste reactors are limited to a particular physical form of waste material, see for example U.S. Pat. No. 4,499,833. Cyclone incinerators, as in U.S. Pat. No. 3,855,951 are useful for burning trash or the like but do not provide for sufficiently complete combustion for use with hazardous waste. The present invention provides a relatively simple system that operates at a higher temperature for substantially complete decomposition of hazardous waste and may be economically installed at the site of waste production.

SUMMARY OF INVENTION

The present invention comprises a hazardous waste thermal decomposition reactor wherein very high temperatures are maintained within a liner that does not decompose when exposed to air, is not abraded by solids in a process gas stream and will not react with hazardous wastes being processed. This system provides for direct operation upon liquids, gases and solids and for controlling residence time within an incineration zone for chemical decomposition of the waste in the reactor hereof to mostly carbon dioxide and water. High temperature waste reactors are often termed thermal destruction reactors, however, the waste is actually decomposed and thus the term thermal decomposition is herein employed to identify reactions which occur in oxidizing, inert and/or reducing environments and combinations thereof.

There is herein provided a hollow high temperature electrically heated core with a stream of carrier gas passed longitudinally therethrough. Hazardous waste in finely divided or gaseous form is introduced into this gas stream with control being provided over the residence time of waste within the reaction zone or volume.

The products of reaction in the core hereof are non-leachable ash which falls out of the bottom of the core and exit gases which may be operated upon to separate same into useful components and harmless carbon dioxide and water. The ash residue is a particulated, glassified, non-leachable solid that may be disposed of as conventional municipal waste. Hazardous components of solid waste can be encapsulated in an unleachable form so as to comply with the most stringent safety requirements and legal regulations.

BRIEF DESCRIPTION OF DRAWINGS

The present invention is illustrated with respect to preferred embodiment thereof in the accompanying drawing, wherein.

DESCRIPTION OF PREFERRED EMBODIMENTS

Figure 1:
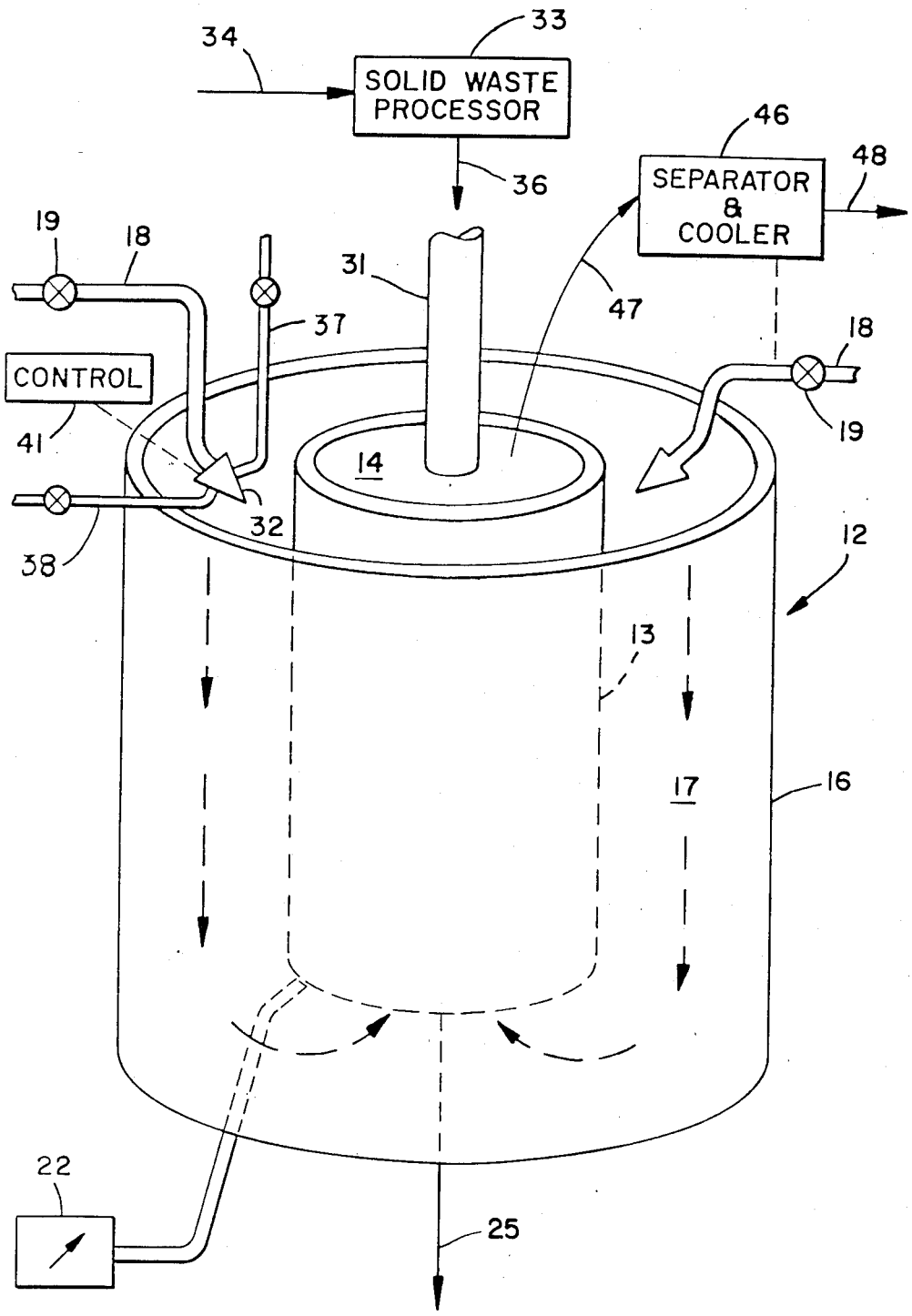
FIG. 1 is a schematic representation of a system in accordance with the present invention.

The present invention incorporates a thermal decomposition reactor 12 having a core 13 which is illustrated in FIG. 1 of the drawings as comprising a hollow cylinder defining an internal reaction volume or zone 14. This core may be formed, for example, of silicon carbide, titania or zirconia. A cylindrical heat insulated shell 16 surrounds the core 13 with suitable end caps, not shown, completing encapsulation of the core. An annular space 17 is provided between core 13 and shell 16 with this space 17 being sealed from the reaction zone 14 at the top thereof. A carrier gas is introduced into the top of this annular space, as indicated by the arrows 18. This carrier gas may comprise a wide variety of gaseous substances such as air or nonreactive gases like nitrogen, argon or carbon dioxide, for example. This carrier gas flows downwardly through the annular space 17 about the core 13 and hence upwardly through the reaction volume 14 of the core, as indicated by the arrows in the drawing and means, schematically illustrated as valves 19, control the flow of carrier gas through the reactor. Provision is made for raising the temperature of the interior of the core and particularly the reaction volume 14 therein to a very high temperature such as 1500° F. to 2,900° F. or more. To this end, core 13 is electrically heated, by passing an electrical current therethrough, as schematically illustrated by a controllable exterior power supply 22.

Provision is made for controllably inserting hazardous waste into the top of the reaction volume 14 within the core 13. This is schematically illustrated in the drawing by a conduit 31 extending vertically downwardly into the top center of the core. For solid hazardous waste, it is herein provided that same shall be first operated upon, as generally indicated by the solid waste processor 33 receiving hazardous waste at 34 and grinding same to predetermined particle size. This particulate waste is passed into the reaction volume 14 through the conduit 31, as indicated by the arrow 36.

Liquid and gaseous waste is inserted into the reactor by mixing same with the carrier gas. A controllable nozzle 32 is provided to receive carrier gas and liquid waste through a line 37 or gaseous waste through a line 38. It is noted that solid waste may be mixed with an inert glassification additive.

The reaction volume 14 within the core 13 is physically separated from the annular space 17 about the core at the top of the reactor and gases which travel or flow upwardly through the reaction volume or zone 14 of the core will exit from the top of the core to be fed, for example, to a separator 46, as indicated by the arrow 47. Inasmuch as these exit gases have a high temperature, the separator 47 preferably includes a cooler so that vent gases directed into the atmosphere, as indicated by arrow 48 can produce no detrimental environmental results. If desired, the separator 46 may be employed to remove vent gases of the reactor and return same into the system of the reactor for entry into the reactor at 18, as indicated by the dashed line in the drawing. The details of such separation form no part of the present invention and are thus not described herein.

Within the reaction zone 14 of the present invention there is provided an upwardly moving column of carrier gas, and solid hazardous waste in a finely divided form is fed into the top of the reaction zone so as to fall downwardly through the reaction zone wherein an extremely high temperature is maintained by passing an electrical current through the core to heat same. These hazardous wastes undergo what may be termed "thermal decomposition" and are turned into carbon dioxide or water and also possibly a solid ash which is a glassified, non-leachable solid which falls by gravity from the bottom of the reaction zone and then may be removed from the shell 12 as indicated by the arrow 25. This solid ash which exits from the reactor of the present invention is quite safe and can be disposed of as conventional municipal waste. The glassified nature of the ash comprises a chemical association of waste and glass and the non-leachable characteristic insures permanent encapsulation so that the waste will never again enter the environment.

The present invention is adapted to handle gaseous, liquid or solid hazardous waste and embodies particular provisions for dealing with the differing physical properties of the separate states of waste. Considering first the processing of gaseous hazardous waste such may be accomplished with little or no processing. Gaseous hazardous wastes can be mixed at low levels with gas or air streams and ejected through a nozzle or the like 32 into the reactor. Gaseous hazardous waste need not be concentrated before processing herein, inasmuch as there is no lower concentration limit. It is, however, noted in this respect that the economics of operating the reactor with a very dilute feed stream and thus low load level may be a factor in determining the desired concentration of entering waste. Secondly, for liquid hazardous waste such as solvents, for example, it is provided herein that the liquid waste may be fed into entering carrier gas which swirls about the space 17 to enter the bottom of the reactor zone 14 and pass upwardly therethrough for high temperature decomposition. This temperature can be of the order of 2900° F. The liquid injection means 32 is preferably provided as an ultrasonic nozzle which can be controlled by the control means 41 to provide a selected size range for the droplets generated therein and sprayed into the reactor. These fine droplets are mixed and entrained in the flowing carrier gas in the reaction zone 14 in such a manner that the droplet size can be selected to control the residence time of the liquid waste in the reaction zone 14 for chemical decomposition therein. It is noted that a combination of upflow and downflow units may be employed to insure complete thermal decomposition. The present invention will thus be seen to provide for controlling the residence time of finely divided hazardous waste within the reaction zone of the reactor. When used the rate of flow of the carrier gas may be varied as a part of this control of the residence time for droplets in the reaction zone to ensure complete destruction of the waste.

Solid hazardous organics, for example, are herein processed by first grinding the waste into millimeter size and then feeding same into the reactor for destruction. The residence time of such particulate solid waste may be controlled by grinding the waste in size ranges from 50 to 1200 Microns, depending upon the density of the solids and the residence time desired. Thus for solid hazardous waste the processor 33 provides for grinding the solids into desired particle sizes and under the circumstances where particles decrease in size in passage through a reaction zone of the present invention, it may be desirable to provide a downflow and upflow reaction zone to insure complete thermal decomposition of the hazardous waste. The solid ash formed from particulate solid hazardous waste comprises a glassified, nonleachable solid that may be disposed of as conventional municipal waste at the exit 25 from the reactor.

The present invention is applicable to additional hazardous waste disposal systems. For example there exists contaminated ground water containing solvent or organic hazardous waste which may be processed in the processor 33 containing a continuously moving carbon absorption bed which concentrates the hazardous waste in a special process vessel containing carbon granules. These granules are then slowly feed into and are then processed by the hazardous waste thermal decomposition reactor hereof in the manner described above. Such carbon granules, then reactivated, are fed back into the absorption bed in the processor 33. Such a process has the capability of being able to handle contamination levels down to parts per billion level.

The present invention is also applicable to solids having heavy metal contamination that must be treated as hazardous. Inasmuch as the present invention produces a glassified ash solid that encapsulates the heavy metals in an unleachable form; there thus is produced from the present system a product that will never re-enter the environment as a heavy metal by natural means.

The present invention is adapted to be installed at the location of hazardous waste generation, as for example at semiconductor manufacturing plants, chemical plants, and the like. The reactor hereof may be quite small as compared to the conventional hazardous waste processing facilities and is compatible with mechanical and electrical systems of manufacturing plants. Also, operation of the present invention is uncomplicated so that plant personnel may well operate the system. In addition, there are no problematic hazardous or noxious products emitted by the present invention, such as NOx or acid gas emissions and thus the system is quite safe for wide spread use.

Reference is now made to FIG. 2 through 5 illustrating a preferred embodiment of a hazardous waste reactor in accordance with the present invention. The reactor 51 is shown to include an elongated open-ended cylindrical shell or vessel 52 formed of stainless steel or other high temperature material having structural rigidity, surrounded by a heat insulator 53 and flanged at both ends. Within the shell or cylinder 52 there is provided a cylinder 54 positioned coaxially with the shell and spaced therefrom to define an annular space 56. The cylinder 54 is formed of Hastalloy-C, or other high temperature material and within the same there is provided a tube 61 concentric therewith and defining an annular space 62 between the tube 61 and cylinder 54. The tube 61 is formed of a high temperature material such as alumina or mullite.

The cylinder 54 is shown to have an exterior flange about the top thereof and this is mounted upon a top plate 66 so that the cylinder depends therefrom. A bottom flange 67 on shell 52 is separated from the bottom of the cylinder 54 so that the annular space 62 is enclosed between the cylinder 54 and 61. Between the bottom flange 67 and the lower end of cylinder 54 there is provided a lateral opening below the cylinder 54, as indicated at 68, to provide communication between the annular spaces 56 and 62. The inner tube 61 is mounted and ceramically cemented upon the lower flange 67 and extends upperwardly therefrom short of the top plate 66 so as to provide communication between the annular space 62 and the interior of the tube 61.

The reactor 51 is futhermore provided with a central cylindrical core 71 concentrically positioned within the tube 61 and spaced laterally therefrom to define an annular space 72 about the core. This core is mounted upon the upper plate 66 and depends therefrom axially of the reactor into spaced relation to the bottom flange 67. Further with regard to the core 71, it is noted that same is formed of a high temperature electrically conducting ceramic material such as silicon carbide, titania or zirconia. The core 71 is formed as an elongated hollow cylinder having a pair of spiral slots 74 and 75 therethrough extending downwardly from the top on diametrically opposite sides of the core for a short distance, these slots then being turned to spiral about the core in extension downwardly and alternated in such a manner that two independent electrically conductive paths are formed. The configuration of slots 74 and 75 will be seen to define a pair of interleaved helices 76 and 77 intertwined over the majority of the length of the core and joined together at the bottom of the core where the slots terminate short of the bottom. The two helices 76 and 77 will be seen to be separated at the top of the core and over substantially all of the length there of and to be connected together at the bottom of the core. This then provides for electrical energization of the core by passing a current from the top of one helix through the length thereof to the bottom and thence upwardly through other helix to the top of the core. A connector 81 is schematically illustrated at the top of the core in extension through the upper plate 66 with conductors 82 connected thereto for controlled passage of current through the core for heating same.

Provision is made for passing a gas through the reactor hereof and to this end there are shown inlet pipes 86 and 87 extending radially outward through the shell 52 and insulation 53 adjacent the top of the reactor. Provision is also made for the exit of gas and reactor products from the bottom of the reactor and to this end bottom flange 67 is shown to have a central axial opening 88 therethrough. This opening will be seen to communicate with the interior of the tube 61 below the bottom of the core 71.

Beneath the shell 52 there is provided an insulated discharge chamber 91 defined by a cylinder 92 abutting the lower flange 67 and having an apertured bottom plate 93 closing the chamber. This discharge chamber communicates with the interior of the reactor through the opening 88 in the lower flange 67 of the reactor and there is provided an outlet pipe or pipes 96 and a bottom discharge port 97 for the ultimate removal of ash formed in the reactor hereof. This bottom section is added when solid hazardous waste is processed; otherwise it is replaced by a simple 2 inch stainless steel pipe cross.

Figures 2, 3, 4, 5:
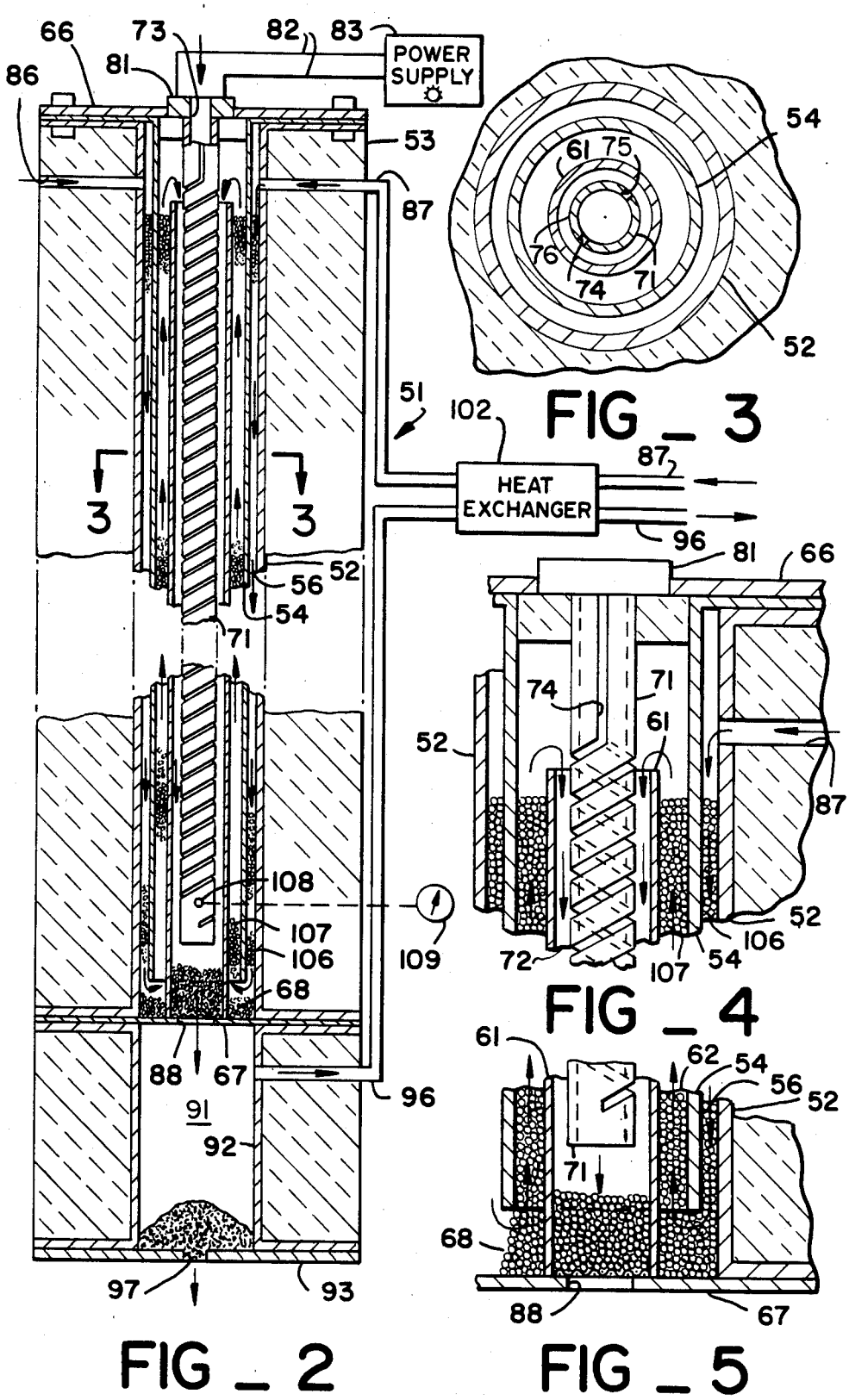
FIG. 2 is a central vertical sectional view of a high temperature hazardous waste reactor in accordance with the present invention.
FIG. 3 is a transverse sectional view taken in the plane 3—3 of FIG. 2.
FIG. 4 is an enlarged partial central sectional view of the upper end of the reactor of FIG. 1.
FIG. 5 is an enlarged partial central sectional view of the upper end of the bottom of the reactor proper.

In order to maximize the heat efficiency of the reactor there is also preferably provided an external heat exchanger 102 through which the inlet pipe 87 and the outlet pipe 96 pass. It will be appreciated that all inlet pipes, such as pipes 86 and 87, as illustrate in FIG. 2, are connected together as by a manifold and pass through the heat exchanger 102 for initial heating of influent gas by the heat remaining in the effluent or exit gases in the exhaust pipe 96.

Further to the preferred embodiment of the thermal decomposition reactor hereof as illustrated in FIGS. 2–5, it is noted that interiorly of the shell 52 in the annular space 56 there is provided a packed bed of ⅛" catalyst support in the form of alumina spheres or the like, 106, extending upwardly from the bottom plate 67 to a level slightly below the inlet pipes 86 and 87. This packed bed 106 extends through the opening 68 into the annular space 62 between the cylinders 54 and 61. In the annular space 62 there is thus provided a further packed bed 107 extending from the bottom plate 67 upwardly to the same level as the outer bed 106 and immediately below the top of the tube 61. These packed beds 106 and 107 are provided for the purpose of enhancing the transfer of heat, as further discussed below. For reactor configurations not processing any solids in the core space 73, the bottom region of the cylinder 61 is also filled with catalyst support for heat exchanging exit gas heat to the feed gas entering annular region 62. For reactors processing solids, this catalyst packing is eliminated.

The reactor described above is adapted to decompose hazardous waste in the gaseous, liquid or solid form and waste liquid or solids are preferably introduced into the center of the reactor through an opening 73 at the top of the core 71. Suitable injection means, not shown, are employed to insert a stream of finely divided solid particles or fine droplets of liquid into the core through the opening 73. Gaseous waste is introduced into the reactor by inclusion in a gas stream supplied to the inlet 87. Provision is made for preventing gas from exiting through the opening 73.

Considering now the operation of the reactor of FIGS. 2 through 5 and considering an example of a gaseous waste, it is noted that such gas may be directly mixed with an air stream and applied to the inlet pipe 87. Flow of air and gas through the reactor may be accomplished either by applying same under pressure to the inlet pipe 87 or alternatively by drawing a vacuum through the reactor via the outlet pipe 96. The stream of air and gas entering pipe 87 is first passed through the external heat exchanger 101 for initial heating by residual heat of the exhaust from the reactor passing through the pipe 96. The preheated stream of air and gas is then directed into the annular space 56 between the shell 52 and cylinder 54 whereas the stream passes downwardly through packed bed 106 and thence through the opening 68 below the cylinder 54 and upwardly through the packed bed 107. The core 71 is heated to a very high temperature as of the order of 1600° F. to 2900° F. or more. This heating is accomplished by passing a current through the core from one half of the top thereof downwardly to the bottom of the core and back up through the other half from a variable power supply 83. This power supply provides for controlling voltage and current applied to the core in order to control the temperature thereof. An internal thermocouple 108 is located internally of the core adjacent to the bottom thereof and is connected to provide a reading of the temperature of the core at a meter 109. The temperature of the core may be adjusted and maintained at a desired level by varying the voltage and current supplied to the core by the power supply 83 to achieve the desired temperature, indicated by the meter 109.

The heat generated by the high temperature core 71 will be radiated laterally outward of the core to heat the tube 61 and this heat will pass through the packed bed 107, the cylinder 54, and the packed bed 106. Influent gas and air passing through the packed beds 106 and 107 will be thus heated to a very high temperature before this stream of air and gas reaches the core.

As this stream emerges from the top of the packed bed 107 it will pass over the top of the tube 61 into the annular space 72 about the core and also some will pass through the slots 73 and 74 in the core into the interior thereof. This air and gas will then pass downwardly to the bottom of the interior of the reactor while experiencing very high temperature heating to produce effective thermal decomposition of the gaseous waste products being carried by the air stream into safe carbon dioxide and water. In hazardous waste solid processing, the temperature achieved is sufficient to glassify and reduce the waste to a nonleachable ash which is carried by the air stream into the chamber 91 below the reactor and retained therein by very fine screening so that the air stream may exit the pipe 96 for subsequent processing, as described above.

The reactor described above has been employed to decompose a wide variety of chemicals and there is set forth in the following table the results of a plurality of reactor runs.

TDR DESTRUCTION LEVELS ON LABORATORY SAMPLES

| Constituent (POHS) | Feed Level | TDR Temp. °F. | TDR Exit ppb | NOx ppm | DRE Level % | Comments |
|---|---|---|---|---|---|---|
| Methylene | 65% | 1760 | 0.105 | <1 | 99.99995 | Dup. Runs |
| Chloride | 65% | 2043 | 0.132 | <1 | 99.99995 | 1 hr feed |
| Xylene | 4% | 2360 | 0.016 | 19 | 99.99987 | 1 hr feed |
| | 27% | 2360 | 0.160 | 19 | 99.99986 | 1 hr feed |
| Ethyl | 6% | 2360 | 0.016 | 19 | 99.99985 | 1 hr feed |
| Benzene | 16% | 2360 | 0.008 | 19 | 99.99998 | 1 hr feed |
| Hexa- | 100% | 1680 | 0.080 | 1.0 | 99.996 | solid feed |
| chloro- | 100% | 2063 | 1.48 | 1.5 | 99.997 | solid feed |
| benzene | | | | | | |
| Freon 113 | 10% | 2300 | 12.9 | 14 | 99.99871 | liquid feed |
| Cholorform | 10% | 2300 | 0.29 | 14 | 99.99997 | liquid feed |
| Toluene | 10% | 2300 | 2.7 | 14 | 99.99973 | liquid feed |
| Benzene | 10% | 2300 | 0.20 | 14 | 99.99998 | liquid feed |

-continued

TDR DESTRUCTION LEVELS ON LABORATORY SAMPLES

| Constituent (POHS) | Feed Level | TDR Temp. °F. | TDR Exit ppb | NOx ppm | DRE Level % | Comments |
|---|---|---|---|---|---|---|
| Acetone | 10% | 2300 | 9.0 | 14 | 99.99909 | liquid feed |
| Methyl ethyl ketone | 10% | 2300 | TBD | 14 | TBD | liquid feed |
| Isopropanol | 10% | 2300 | 1.1 | 14 | 99.99989 | liquid feed |
| Hexa-chloro-benzene | 0.01% | 2300 | ND | 14 | ND | liquid feed |
| Methyl Alcohol | 10% | 2300 | TBD | 14 | TBD | liquid feed |
| Ethanol | 10% | 2300 | 2.0 | 14 | 99.99980 | liquid feed |
| Carbon Tetra-chloride | 10% | 2300 | 0.18 | 14 | 99.99998 | liquid feed |

(TBD = to be determined)
(ND = not detectable)

The present invention has been described above with respect to a particular preferred embodiments, however, it will be appreciated by those skilled in the art that numerous modifications and variations are possible within the spirit and scope of the invention and thus it is not intended to limit the invention to the precise terms of description or details of illustration.

What is claimed is:

1. A hazardous waste disposal system comprising a hollow high temperature cylindrical core defining a central reaction zone, a shell about said core and defining an annular space thereabout communicating with said reaction zone interior, means for heating said core for raising the temperature thereof to a very high temperature in excess of 1500 degrees fahrenheit, means directing a carrier gas in a flow through said annular space for preheating said gas and then through said reaction zone, means continuously inserting hazardous waste into said reaction zone in a finely divided or gaseous form to produce carbon dioxide and water and a safe particulate solid reaction product from said solid waste, and means for removing said solid reaction product from a bottom end of said reaction zone.

2. The system of claim 1 further comprising means passing an electrical current through said core for raising the temperature thereof to the order of 1600 to 2900 degrees fahrenheit.

3. The system of claim 1 further defined by a solid waste processor receiving solid hazardous waste and operating thereon to reduce the waste to particles having a controllable size in the range of 50 microns to 1200 microns, and injection means directing said particles into a top of said core to pass downwardly through said reaction zone in counter flow to said carrier gas for controlling residence time of said particles in said zone.

4. The system of claim 1 further defined by means controllably injecting liquid or gaseous waste into said flow of carrier gas and including a controllable nozzle to establish the size of liquid droplets as a control of residence time in said reaction zone.

5. The system of claim 1 further defined by gas exit means including a cooler connected to receive carrier gas flowing from the top of said core for reducing gas temperature and discharging cooled gas into the atmosphere.

6. The system of claim 1 further defined by said core being formed from a high temperature material that is non reactive in the presence of oxygen at very high temperature whereby hazardous wastes including chemically bonded oxygen may be directly processed at high temperatures for decomposition.

7. The system of claim 6 further defined by said core being formed of a material chosen from the group of silicon carbide and zirconia or titania.

8. The system of claim 1 further defined by a cylinder disposed within said shell about said core and defining an annular space between shell and cylinder, and a packed bed disposed in said annular space for transferring heat to said carrier gas in passage through said packed bed.

9. The system of claim 8 further defined by a tube disposed concentrically within said cylinder and spaced therefrom, and said packed bed extending through an opening in said cylinder into the space between said tube and cylinder.

10. The system of claim 1 further defined by said core being hollow and divided into two halves longitudinally thereof from the top to a short distance from the bottom by a pair of slots spiraling about the core to define an elongated electrical path between the two halves at the top of the core, a variable power supply connected between the two halves of said core at the top thereof, and a top plate across the top of said shell and mounting said core to depend therefrom.

11. The system of claim 1 further defined by a heat exchanger disposed exteriorly of said shell and connected for passage of reactor influent and effluent carrier gas therethrough for heat exchange therebetween.

12. A hazardous waste disposal system comprising a reactor having a central substantially vertical hollow core of material impervious to oxygen and very high temperatures in excess of 1500° farenheit and defining a vertical reaction zone therethrough, means forcing a carrier gas through said reaction zone, means heating said core to a very high temperature, means continuously feeding hazardous waste in finely divided solid form into the top of said reaction zone though which carrier gas flows, means controlling the residence time of hazardous waste in said reaction zone for producing carbon dioxide, water and glassified non-leachable solid particles of said waste as the product of said reactor, and means removing the product of said reactor from the bottom of said reaction zone for conventional waste disposal.

13. A hazardous waste reactor system comprising means defining a central reaction zone an electrical heater disposed through said reaction zone for energization to rise the temperature thereof to the order of 1600° fahrenheit or more, means defining at least one packed bed adjacent said reaction zone for receiving heat therefrom, means forcing a carrier gas through at least one of said packed beds and into said reaction zone, and means injecting hazardous waste in liquid or gaseous form into said carrier gas exteriorly of said reaction zone for heating in said packed bed and decomposition by heat in said reaction zone.

14. The system of claim 13 further defined by said means defining at least one packed bed further defining adjacent counterflow passages about said reaction zone in heat conducting relation to each other and to said reaction zone for heating hazardous waste in said carrier gas to a very high temperature before entry into said reaction zone.

15. The reactor system of claim 13 further defined by said means defining said reaction zone and said packed beds comprising concentric cylinders with packed beds therebetween for defining tortuous labyrinthine paths for carrier gas before entering said reaction zone.

16. A hazardous waste reactor system comprising means defining a central reactor zone, an electrical heater disposed in said reactor zone for energization to raise the temperature thereof to the order of 1600° F. or more, means defining a plurality of packed beds in heat exchange relation to said reactor zone, means forcing a carrier gas through said packed beds and said reactor zone, and means controllably injecting hazardous waste in liquid or gaseous form into said carrier gas for passage through said packed beds and reactor zone to decompose said hazardous waste into safe residue.

17. The system of claim 16 further defined by said means defining a reactor zone comprising a tube, and said means defining packed beds including a plurality of concentric cylinders about said tube with end connections for establishing an elongated heat exchange path for carrier gas and hazardous waste prior to entry into said reactor zone for raising said waste to predetermined temperatures in zones defined by separate packed beds.

* * * * *

UNITED STATES PATENT AND TRADEMARK OFFICE

CERTIFICATE OF CORRECTION

PATENT NO. : 4,688,495

DATED : August 25, 1987

INVENTOR(S) : Terry R. Galloway

It is certified that error appears in the above-identified patent and that said Letters Patent are hereby corrected as shown below: Title page, Item [63] change "March 25, 1977 to -December 13, 1984-

Column 1, line 6, change "3/25/77" to -12/13/84-

Signed and Sealed this

Twenty-third Day of February, 1988

*Attest:*

DONALD J. QUIGG

*Attesting Officer*

*Commissioner of Patents and Trademarks*